US007448718B2

(12) United States Patent
Haflinger

(10) Patent No.: US 7,448,718 B2
(45) Date of Patent: Nov. 11, 2008

(54) DETERMINING DEFECTIVE RESISTORS IN INKJET PRINTERS

(75) Inventor: James J. Haflinger, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 228 days.

(21) Appl. No.: 11/536,906

(22) Filed: Sep. 29, 2006

(65) Prior Publication Data

US 2008/0079764 A1 Apr. 3, 2008

(51) Int. Cl.
*B41J 29/393* (2006.01)

(52) U.S. Cl. ..... 347/19

(58) Field of Classification Search ..... 347/19; 324/416, 443, 444, 549, 555, 691, 718
See application file for complete search history.

(56) References Cited

U.S. PATENT DOCUMENTS 3,414,811 A * 12/1968 Carter ..... 324/703
6,199,969 B1 3/2001 Haflinger et al.
6,963,196 B2 * 11/2005 Mende ..... 324/117 H
2002/0109414 A1 8/2002 Noboru

* cited by examiner

*Primary Examiner*—Lamson D Nguyen
(74) *Attorney, Agent, or Firm*—Mark G. Bocchetti

(57) ABSTRACT

A method and apparatus for determining defective heating resistors $R_i$ in each of a plurality of inkjets in an inkjet printer, wherein each heating resistor $R_i$ is connected in parallel with a common capacitor, the method for each heating resistor $R_i$ includes providing a variable power supply effective in a first condition to produce a first operating DC voltage and, in a second condition, to produce a second known test DC voltage $V_r$, and inserting a known reference resistor $R_r$ in series with the heating resistor $R_i$ and capacitor and also open circuiting the capacitor in response to sensing that the power supply has changed from the first condition to the second condition. The method and apparatus further include digitizing the voltage $V_i$ at the electrical junction between the heating resistor $R_i$ and the reference resistor $R_r$, and using the digitized voltage to determine if the heating resistor $R_i$ is defective.

11 Claims, 3 Drawing Sheets

DETERMINING DEFECTIVE RESISTORS IN INKJET PRINTERS

FIELD OF THE INVENTION

The present invention relates to determining defective heating resistors in an inkjet printer. More generally it relates to circuitry which functions in an operating mode when the voltage supply is at the operating voltage level, and automatically switches to a test mode to test circuit components when the voltage supply is at a test voltage level.

BACKGROUND OF THE INVENTION

Inkjet printers include a printhead having a plurality of inkjets. Each inkjet has a heating resistor that, in response to current, produces heat that causes the ejection of ink droplets. If the heating resistor is electrically malfunctioning, artifacts can be produced in the printed image.

U.S. Pat. No. 6,199,969 discloses several different ways of determining defective resistors in an inkjet printer, which measure test currents discharging from a capacitor.

Other applications containing arrays of circuit elements which require isolation from the driving circuitry to enable accurate monitoring of the circuit elements include lights on a scoreboard, an array of light emitting diodes in a display, or a group of relays in a switching system.

SUMMARY OF THE INVENTION

It is therefore an object of the present invention to provide an effective way to determine if inkjet printers have defective heating resistors.

This object is achieved by a method of determining defective heating resistors $R_i$ in each of a plurality of inkjets in an inkjet printer, wherein each heating resistor $R_i$ is connected in parallel with a common capacitor, the method for each heating resistor $R_i$, comprising:

a) providing a variable power supply effective in a first condition to produce a first operating DC voltage $V_o$ and, in a second condition, to produce a second known test DC voltage $V_t$;

b) inserting a known reference resistor $R_r$ in series with the heating resistor $R_i$ and capacitor and then open circuiting the capacitor in response to sensing that the power supply has changed from the first condition to the second condition;

c) digitizing the voltage $V_i$ at the electrical junction between the heating resistor $R_i$ and the reference resistor $R_r$; and d) using the digitized voltage to determine if the heating resistor $R_i$ is defective.

In another aspect, an apparatus is taught for use in determining defective heating resistors $R_i$ in each of a plurality of inkjets in an inkjet printer, wherein each heating resistor $R_i$ is connected in parallel with a common capacitor, comprising:

a) a variable power supply effective in a first condition to produce a first operating DC voltage and, in a second condition, to produce a second known test DC voltage $V_t$;

b) a known reference resistor $R_r$;

c) first circuit means for inserting the known reference resistor $R_r$ in series with the heating resistor $R_i$ and capacitor in response to the power supply changing from the first condition to the second condition;

d) second circuit means for open circuiting the capacitor in response to the power supply changing from the first condition to the second condition.

e) an analog to digital circuit electrically connected to the junction of the heating resistor $R_i$ and the known reference resistor $R_r$ for digitizing the junction voltage; and f) means responsive to the digitized junction voltage $V_i$ for determining if the heating resistor $R_i$ is defective.

ADVANTAGES

The present invention can effectively determine if the heating resistors are open circuited or provide too high or low resistance to be effective. This invention does not require the use of expensive amplifiers. By digitizing the voltage at the junction between the reference resistor and the heating resistor, an accurate determination of the effectiveness of the heating resistor can be made.

DETAILED DESCRIPTION OF THE INVENTION

Figure 1:
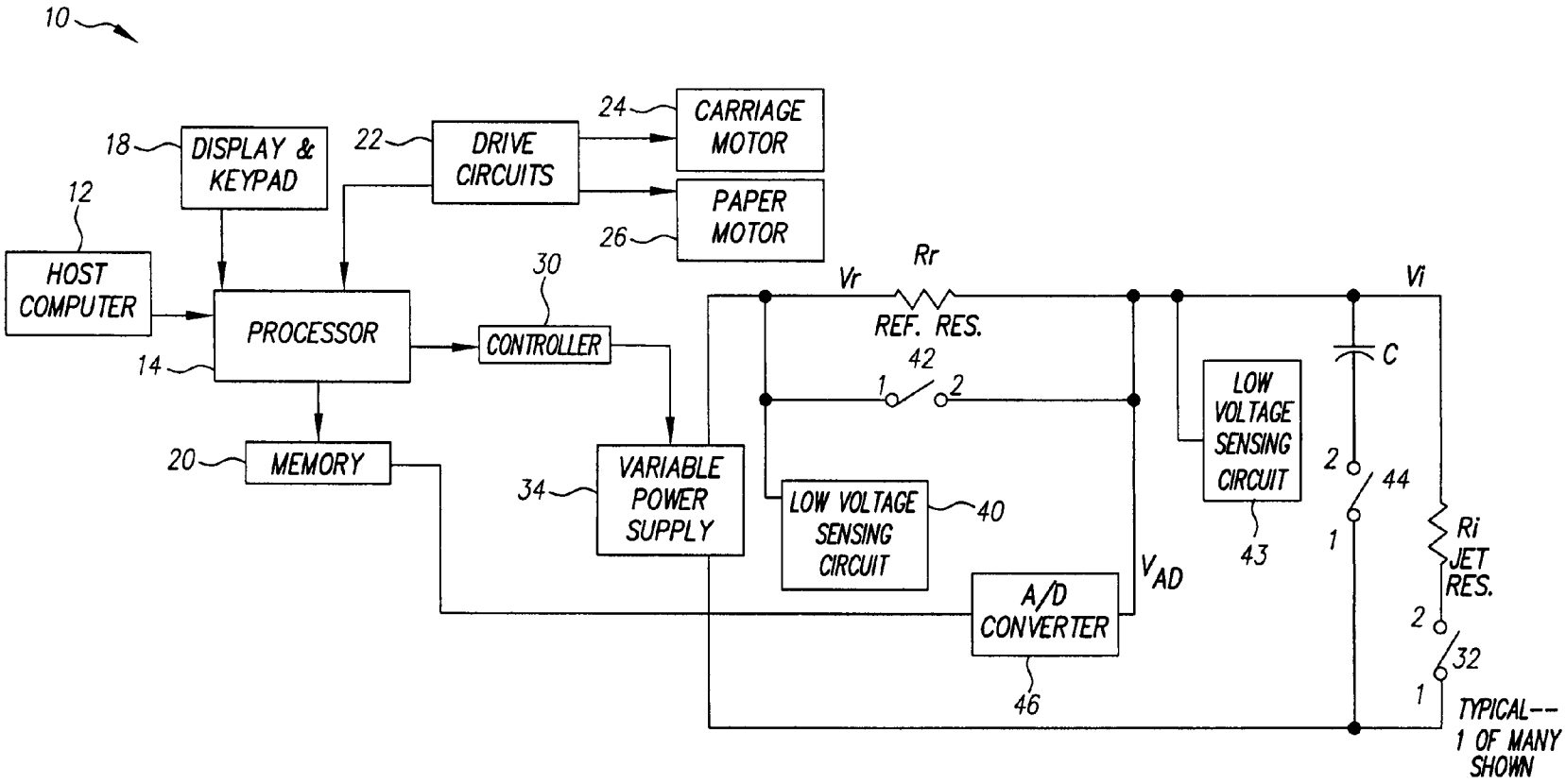
FIG. 1 is a diagram partially in block and partially in schematic form of an embodiment of the present invention.

Turning now to FIG. 1 where a diagram of an inkjet printer 10 is shown. The control electronics for the inkjet printer is shown in block diagram form. A host computer 12 communicates with a processor 14. The host computer 12 has operating software which issues print commands and sends data to the inkjet printer 10. The processor 14 is also coupled to a display and keyboard 18, memory 20, and drive circuits 22 which control a print carriage motor 24 and a paper feed motor 26. The processor 14 provides signals to a controller 30 which actuates switches 32 in a printhead. Only a single inkjet is shown and represented as resistor $R_i$ and switch 32. The other components of the printhead are well known and it is not necessary to show them for understanding the present invention. It will be understood that there are a number of inkjets, each one of which includes a switch 32 and a heating resistor $R_i$. A capacitor C is connected in parallel with the heating resistor $R_i$. During a printing operation, the controller 30 provides all input to the variable power supply 34 which causes the power supply 34 to be effective in a first condition and produce a high level operating voltage which charges the capacitor C. When the controller 30 closes switch 32 current flows through the printhead heating resistor $R_i$. Heat from the resistor $R_i$ causes the ejection of a droplet of ink by the inkjet in the well known manner.

The present invention is concerned with operating in a test mode for determining if the heating resistors $R_i$ are defective. In a test mode, the controller 30 provides an input to the variable power supply 34 which causes it to operate in a second condition and produce a test voltage $V_t$. The test voltage $V_t$ is lower than the operating voltage $V_o$. A low voltage sensing circuit 40 senses the reduction in the voltage level when the variable power supply 34 has switched to a test mode and opens switch 42. This action removes a low resistance bypass to a reference resistor $R_r$. Switch 42 consists for example of a field effect transistor (FET) having an on-resistance which is much less than reference resistance $R_r$ when the switch is on. The step of removing the low resistance bypass of $R_r$ will also be referred to as inserting reference resistor $R_r$ into the circuit. Although $R_r$ is in the circuit even when switch 42 is off, if the on-resistance of switch 42 is less than $R_r/3$ (and more preferably is less than $R_r/10$), the circuit behaves approximately as if $R_r$ is not in the circuit, which minimizes the power wasted during the printing operation, particularly if the on-resistance is much lower than the nominal resistance of the heating resistors. A second low voltage sensing circuit 43 responds to reduction in the voltage at the junction between reference resistor $R_r$ and a particular heating resistor $R_i$ and opens switch 44, thereby open circuiting the capacitor C. Switch 32 is closed at this time and there is a serial connection between the resistors $R_r$ and $R_i$. An analog to digital converter 46 senses the voltage $V_{AD}$ and converts it to a digital signal which is applied to the processor 14. While switch 32 is closed and switches 42 and 44 are open, the same current passes through reference resistor $R_r$ and the particular heating resistor $R_i$ and the voltage at the A/D converter is defined as $V_{AD}=V_i$. When all of the switches 32 are open (so that none of the heating resistors are in the circuit), and also while switches 42 and 44 are open, the voltage measured at the A/D converter is given by good approximation as $V_{AD}\sim V_t$. This is because the only current flow through $R_r$ is that allowed by the high input impedance of the A/D converter, so that the voltage drop across the reference resistor is negligible. The voltage $V_i$ is a function of the resistor $R_i$ since the same current flows through resistors $R_r$ and $R_i$. The resistance of $R_i$ is given by the following relationship:

$$R_i=R_rV_i/(V_t-V_i)$$

The processor 14 can compute the value of the resistance of each resistor $R_i$ and provide the values to the display 18. Alternatively, the value of $V_i$ can be compared with an acceptable range of values and the processor 14 can cause the display 18 to visibly indicate that a particular defective resistor is outside of that acceptable range. Also alternatively, the computation of the value of the resistance can be performed in the host computer.

Figure 2:
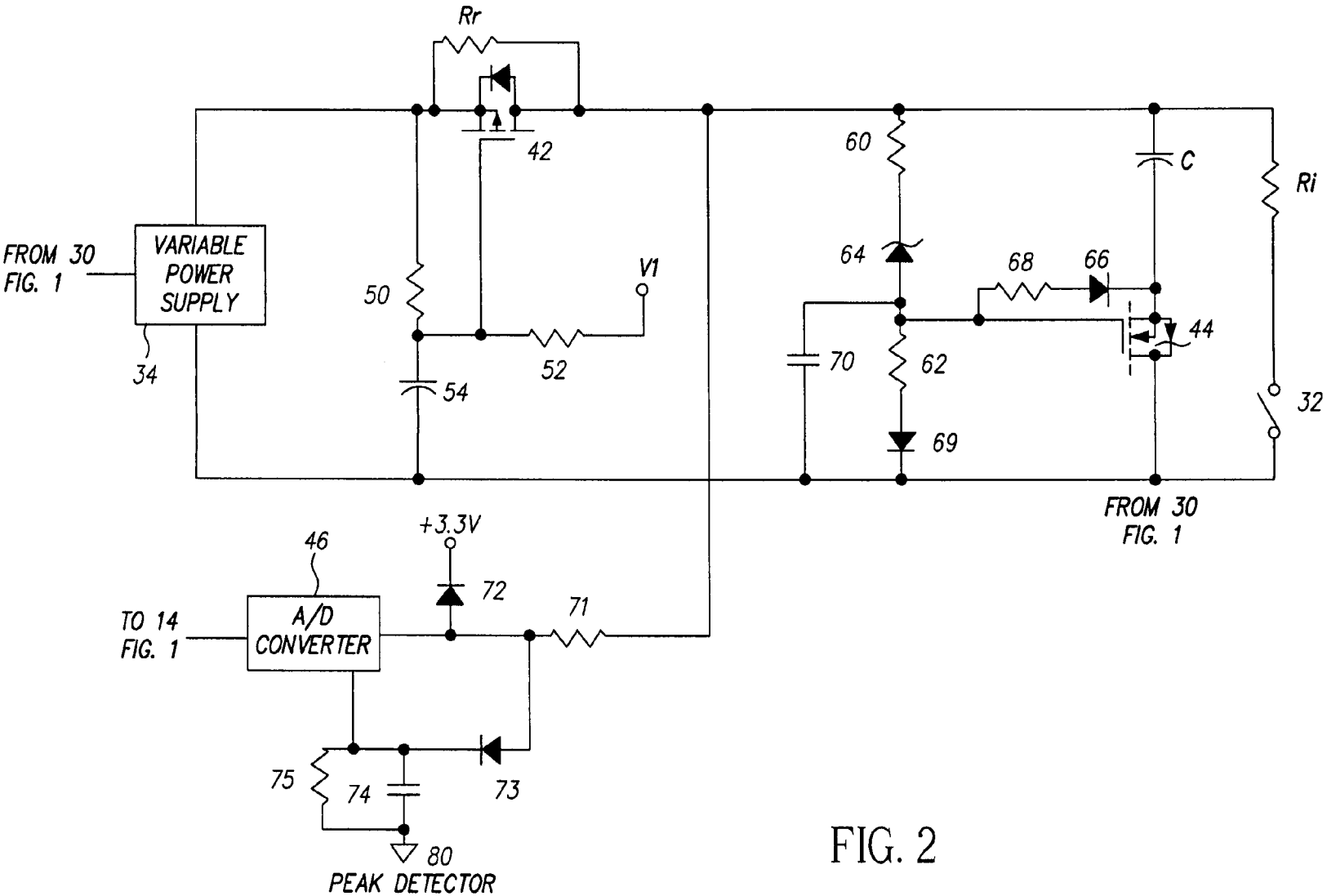
FIG. 2 is a more detailed schematic diagram of the first and second sensing circuits shown in FIG. 1.

Turning, now to FIG. 2 switch 42 is provided by a P-channel FET. In the lows voltage sensing circuit 40, a voltage divider circuit is provided by resistors 50 and 52. The gate of the P-channel FET is connected at the junction of resistors 50 and 52. Resistor 52 is connected to a bias voltage source $V_1$. When the variable voltage supply 34 produces the test voltage $V_t$, the gate voltage minus the source voltage gets close to zero and the P-channel FET switches from conductive to nonconductive thereby inserting the reference resistor $R_r$ into the circuit. A capacitor 54 is connected between resistors 50 and 52 to prevent the voltage $V_i$ from going up and down too slowly. This will introduce a slight delay in the P-channel FET turning on or off, which draws more current out of the capacitor C.

Switch 44 is provided by an N-channel FET in the low voltage sensing circuit 40. A simple voltage divider circuit can be provided by resistors 60 and 62, but it is preferable to put a Zener diode 64 in series with resistor 60 as shown in FIG. 2. Zener diode 64 operates in the breakdown mode at a constant voltage $V_i$ that is higher than $V_t$. It is important to install the N-channel FET with the drain going to ground and the source attached to the negative side of the capacitor. This will take the FET's intrinsic diode (shown as a Zener diode in the FET) out of the picture. If this is not done, there can be a problem when a heating resistor $R_i$ is tested. Assuming $V_t$=3V, the voltage on the positive side of the capacitor C will drop by say 1½ volts with a normal heater. This will cause the negative side of the capacitor to also want to drop by 1½ volts. The intrinsic diode in the N-channel FET will turn on at about 0.7 volt (1 diode drop).

Figure 3:
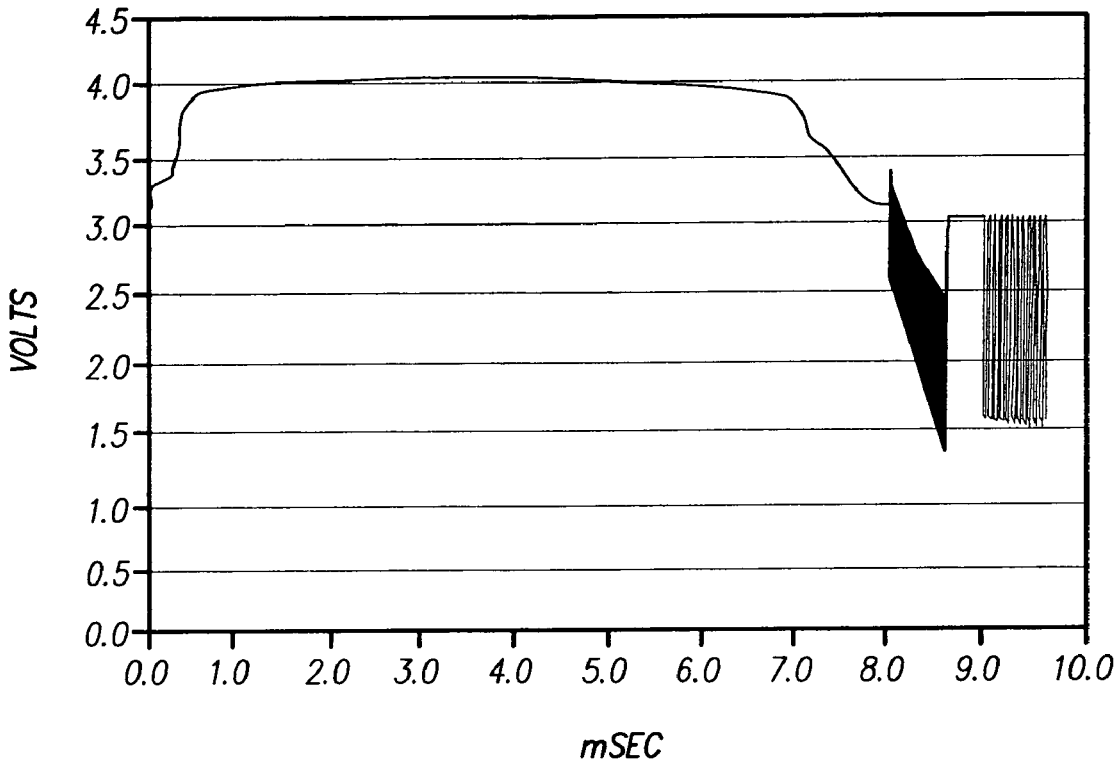
FIG. 3 is a graph which depicts the operation of the FIG. 1 and FIG. 2 embodiment using circuit elements with specific parameter values.

Another issue with the N-channel FET is to prevent it from turning on when the heating resistor $R_i$ is tested. When a heating resistor $R_i$ is energized, the source voltage of switch 44 goes below 0 V (due to capacitor C). The gate is connected such that it will stay above 0 V. This may cause the N-channel FET to start to turn on. To prevent this from happening, it is preferable to put a diode 66 with a small resistor 68 in series between the source and the gate to pull the gate down with the source. A capacitor 70 is connected between resistors 60 and 62 and causes a delay in the N-channel FET turning on and off. Diode 69 takes resistor 62 out of the circuit when the source of the N-FET goes below 0V allowing the resistor 68 diode 66 combination to be more effective without loading down the gate voltage during printing mode ($V_o$). It is also important to lower the voltage slowly enough to bleed most of the charge off of C before FET turns off C. This process will be described when FIG. 3 is discussed. For clarity of understanding FIG. 3, representative circuit element values are given as well as representative voltage levels and timing. Typical values for $R_r$ and $R_i$ are 10 ohms to 10 k ohms. In some applications it is beneficial to set $R_r$ equal to the nominal value of $R_i$.

FIG. 3 shows the voltage $V_{AD}$ at the A/D converter during different stages of its operation. At the beginning of the graph (0 mSec.), the power supply 34 is at 3V. From there it moves up to its nominal printing operating voltage $V_o$ (typically 15V to 32V) and capacitor C becomes charged. To protect the A/D converter from the maximum operating voltage, there is a diode 72 and a resistor 71 attached to 3.3V to prevent $V_{AD}$ from going too high (1 diode drop above 3.3V). In other words, the voltage $V_{AD}$ is limited to 3.3 V plus the voltage drop across diode 72 (typically 0.6 to 0.7 V), i.e. a total of about 4.0 V. At 7 mSec., as the power supply voltage decreases from the operating voltage $V_o$ and capacitor C discharges, the voltage $V_{AD}$ drops below 4V. Switches 42 and 44 open below about 10 V, thereby removing the bypass across $R_r$ and also removing capacitor C from the circuit. This may occur during the timeframe in FIG. 3 when $V_{AD}$ is still clamped at around 4 V. There is no particular order as to when switches 42 and 44 open or close and the order does not affect circuit operation. At 8 mSec., a large group of heaters are fired repeatedly to get the rest of the charge off of the capacitor C. At 9 mSec., the testing of each heater begins. When switch 32 is closed and heater $R_i$ is turned on $V_{AD}$ will go down to about 1.5V if the heating resistor is still at the nominal resistance value. Other switches similar to 32 are closed and opened successively in order to test each heating resistor. All of the heaters tested in this figure are good. In this particular example, reference resistor $R_r$ was chosen to be approximately equal to the nominal value of the heating resistor, so that for Vt~3.0 V and Vi~1.5 V. $R_i=V_iR_r/(V_t-V_i)=1.5\ R_r/(3.0-1.5)=R_r$.

The apparatus and method for monitoring the status of individual circuit elements while isolating them from the driving circuitry can be modified for applications other than an inkjet printer having heater resistors. Applications of interest might include, for example, lights on a scoreboard, an array of light emitting diodes in a display, or a group of relays in a switching system. As will be readily apparent to one skilled in the art, the circuit elements to be monitored will have some electrical characteristic that must be operational, or within a certain range of measurement, if the circuit is to operate properly in the operating mode. This electrical characteristic may be compared to a known reference circuit element. The reference circuit element may be of the same general type as the circuit elements to be monitored (in the same way that reference circuit element $R_r$ is a resistor, similar to the heater resistors). Alternatively, the reference circuit element may be a different type of circuit element than circuit elements to be monitored. For example, suppose the circuit elements to be monitored were transistors or diodes or relays which have an effective resistance in some mode, and the reference circuit element were a resistor.

A common feature in applications of the invention is the effective removal of the known reference circuit element from the circuit in the operating mode, just as switch 42 bypasses the reference circuit element $R_r$ in the first embodiment during operation of the printhead, so that power wastage and voltage drops in $R_r$ are minimized, for example.

Another common feature in applications of this invention is a circuit element of a second type which is connected to the circuit elements to be monitored. This circuit element of the second type, like capacitor C in the first embodiment, is needed for proper operation of the circuit in the operating mode, but would interfere with an accurate monitoring of the circuit elements in a test mode. It is necessary to isolate the circuit element of the second type from the circuit elements to be monitored when in a test mode. This is accomplished by using a switch, analogous to switch 44 from the first embodiment.

Still another common feature in applications of this invention is a variable power supply which is effective in a first condition to produce a first operating voltage, and in a second condition, to produce a second known test voltage. In some embodiments, this voltage will be DC, as in the case of the first embodiment. However, in some other embodiments, the proper operation of the circuit requires an AC voltage from the variable power supply. As will be readily apparent to one skilled in the art, for embodiments having an AC test voltage, additional circuitry (73, 74, 75) such as a peak detector (80) may be incorporated into the measuring circuit, so that the AC voltage can be measured during the test mode.

The invention has been described in detail with particular reference to certain preferred embodiments thereof, but it will be understood that variations and modifications can be effected within the spirit and scope of the invention.

PARTS LIST

10 inkjet print
12 host computer
14 processor
18 display and keyboard
20 memory
22 drive circuits
24 print carriage motor
26 paper feed motor
30 controller
32 switch
34 power supply
40 low voltage sensing circuit
42 switch
43 second low voltage sensing circuit
44 switch
46 analog to digital converter
50 resistor
52 resistor
54 capacitor
60 resistor
62 resistor
64 Zener diode
66 diode
68 small resistor
69 small diode
70 capacitor
71 resistor
72 small diode
73 additional circuitry
74 additional circuitry
75 additional circuitry
80 peak detector

The invention claimed is:

1. A method of determining defective heating resistors $R_i$ in each of a plurality of inkjets in an inkjet printer, wherein each heating resistor $R_i$ is connected in parallel with a common capacitor, the method for each heating resistor $R_i$ comprising:

a) providing a variable power supply effective in a first condition to produce a first operating DC voltage and, in a second condition, to produce a second known test DC voltage $V_t$;

b) inserting a known reference resistor $R_r$ in series with the heating resistor $R_i$ and capacitor and open circuit the capacitor in response to sensing that the power supply has changed from the first condition to the second condition;

c) digitizing the voltage $V_i$ at the electrical junction between the heating resistor $R_i$ and the reference resistor $R_r$; and d) using the digitized voltage to determine if the heating resistor $R_i$ is defective.

2. The method of claim 1 further including reducing the charge on the capacitor before digitizing the voltage $V_i$.

3. The method of claim 1 wherein the resistance value of the heating resistor $R_i$ is calculated by the relationship $$R_i=R_rV_i/(V_t-V_i).$$

4. The method of claim 2 wherein the resistance value of the heating resistor $R_i$ is calculated by the relationship $$R_i=R_rV_i/(V_t-V_i).$$

5. Apparatus for use in determining defective heating resistors $R_i$ in each of a plurality of inkjets in an inkjet printer, wherein each heating resistor $R_i$ is connected in parallel with a common capacitor, comprising:

a) a variable power supply effective in a first condition to produce a first operating DC voltage and in a second condition to produce a second known test DC voltage $V_t$;

b) a known reference resistor $R_r$;

c) first circuit means for inserting the known reference resistor $R_r$ in series with the heating resistor $R_i$ and capacitor in response to the power supply changing from the first condition to the second condition;

d) second circuit means for open circuiting the capacitor in response to the power supply changing from the first condition to the second condition, e) an analog to digital circuit electrically connected to the junction of the heating resistor $R_i$ and the known reference resistor $R_r$ for digitizing the junction voltage; and f) means responsive to the digitized junction voltage $V_i$ for determining if the heating resistor $R_i$ is defective.

6. The apparatus of claim 5 wherein the second circuit means includes a transistor.

7. The apparatus of claim 5 wherein the second circuit means includes an N-channel FET connected between the negative side of the capacitor and ground.

8. The apparatus of claim 5 wherein the first circuit means includes a switch in parallel with the known reference resistance $R_r$, said switch having an on-resistance which is less than $R_r/3$.

9. Apparatus for use in monitoring the status of individual circuit elements within an array of circuit elements of a same first type, wherein each circuit element of the first type is connected to a common circuit element of a second type, comprising:

a) a variable power supply effective in a first condition to produce a first operating voltage and in a second condition to produce a second known test voltage;

b) a known reference circuit element having a electrical characteristic which may be compared to an electrical characteristic of the circuit elements of the first type;

c) a first circuit for inserting the known reference circuit element in series with the circuit element of the first type in response to the power supply changing from the first condition to the second condition;

d) a second circuit for isolating the circuit element of the second type from the circuit elements of the first type in response to the power supply changing from the first condition to the second condition;

e) an analog to digital converter electrically connected to the circuit element of the first type and the known reference circuit element for digitizing the voltage; and f) means responsive to the digitized voltage for determining if a circuit element of the first type is defective.

10. The apparatus of claim 9, wherein the first operating voltage is a DC voltage.

11. The apparatus of claim 9, wherein the first operating voltage is an AC voltage.

* * * * *

UNITED STATES PATENT AND TRADEMARK OFFICE

CERTIFICATE OF CORRECTION

PATENT NO. : 7,448,718 B2
APPLICATION NO. : 11/536906
DATED : November 11, 2008
INVENTOR(S) : James Haflinger It is certified that error appears in the above-identified patent and that said Letters Patent is hereby corrected as shown below:

| | |
|---|---|
| Claim 1, Col. 6, line 18 | delete “circuit” and insert --circuiting-- |
| Claim 5, Col. 6, line 42 | delete “and” and insert --and,-- |
| Claim 5, Col. 6, line 43 | delete “condition” and insert --condition,-- |
| Claim 5, Col. 6, line 51 | delete “condition,” and insert --condition;-- |
| Claim 9, Col. 7, line 5 | delete “and” and insert --and,-- |
| Claim 9, Col. 7, line 6 | delete “tion” and insert --tion,-- |
| Claim 9, Col. 7, line 8 | after “having” delete “a” and insert --an-- |

Signed and Sealed this

Twenty-fourth Day of March, 2009

John Doll

JOHN DOLL
*Acting Director of the United States Patent and Trademark Office*